US005649353A

United States Patent [19]

Salasoo et al.

[11] Patent Number: 5,649,353

[45] Date of Patent: Jul. 22, 1997

[54] METHOD FOR MAKING AN ELECTRICAL COIL

[75] Inventors: Lembit Salasoo; Evangelos Trifon Laskaris, both of Schenectady; Richard Andrew Ranze, Scotia, all of N.Y.

[73] Assignee: General Electric Company, Schenectady, N.Y.

[21] Appl. No.: 514,333

[22] Filed: Aug. 11, 1995

[51] Int. Cl.[6] ..... H01F 7/06

[52] U.S. Cl. ..... 29/605; 29/622; 29/756; 29/33 F; 242/444; 335/216

[58] Field of Search ..... 29/605, 611, 622, 29/599, 756, 748, 33 F; 335/216; 140/93 R; 242/7.03, 444, 445

[56] References Cited

U.S. PATENT DOCUMENTS

| | | | |
|---|---|---|---|
| 3,801,029 | 4/1974 | Malburg | 29/605 |
| 4,078,735 | 3/1978 | Klemer | 242/445 |
| 4,528,532 | 7/1985 | Keim | 335/216 |
| 4,586,017 | 4/1986 | Laskaris et al. | 335/216 |
| 5,187,859 | 2/1993 | Heim | 29/599 |
| 5,361,055 | 11/1994 | Peck | 335/216 |
| 5,410,288 | 4/1995 | Dorri et al. | 335/216 |
| 5,512,870 | 4/1996 | Salasoo et al. | 335/216 |

FOREIGN PATENT DOCUMENTS

| | | | |
|---|---|---|---|
| 23909 | 4/1950 | Finland | 29/605 |

*Primary Examiner*—Peter Vo
*Assistant Examiner*—Khan Nguyen
*Attorney, Agent, or Firm*—Douglas E. Erickson; Marvin Snyder

[57] ABSTRACT

A method for making an electrical coil such as a superconductive switch or an energy dump resistor. The midportion of a coil wire, whose ends are wound around two supply spools, is looped around a radially-extending pin on a shaft. The shaft is turned in one direction and the coil wire is guided such that segments are paid out from the first supply spool and sections are paid out from the second supply spool, such segments and sections being wound from the middle to a corresponding end, then being wound from the corresponding end to the middle where they are crossed over, and then being wound from the middle to the other associated end. A stratum of electrical insulation is positioned, at the appropriate time, on the second segment and second section, and, in the case of the switch, an electrical heater is positioned, at the appropriate time, on the first segment and first section.

10 Claims, 3 Drawing Sheets

METHOD FOR MAKING AN ELECTRICAL COIL

BACKGROUND OF THE INVENTION

The present invention relates generally to electrical coils and more particularly to a method for making an electrical coil having high voltage and low inductance.

Electrical coils have been made by winding an electrically-insulated coil wire around, and between the ends of, a coil form. Additional layers of coil wire are wound back-and-forth between the ends of the coil form around the turns of a previously-wound layer of coil wire. Conventional electrical coils having high voltage and low inductance, such as the superconductive coil portion of a conventional superconductive switch, have been made from heavily electrically-insulated coil wire wound in a two-in-hand bifilar manner (i.e., adjacent turns in the same layer of coil wire, or the turns in adjacent layers of coil wire, are wound alternately clockwise and counterclockwise as one travels along and between the two ends of the coil wire). Electrical coils include, without limitation, the resistive coil portion of an energy dump resistor and, as previously mentioned, the superconductive coil portion of a superconductive switch.

It is noted that superconducting devices have a main superconductive coil assemblage and include, but are not limited to, magnetic resonance imaging (MRI) systems for medical diagnosis, superconductive rotors for electric generators and motors, and magnetic levitation devices for train transportation. Superconductive devices usually employ a superconductive switch to transfer between a persistent superconducting operating mode and a non-persistent superconducting operating mode. Typically a superconductive switch is used to start up superconductive operation of the superconductive device and to purposely run down such superconductive operation.

Known superconductive switches are placed in a cryogenic region of the superconductive device where the operating temperature is less than or equal to the critical temperature of the superconductor material used in the main superconductive coil assemblage of the superconductive device. Such a superconductive switch typically has a superconductive coil portion (as previously mentioned) and an electrical heater portion. The coil wire of the superconductive coil portion has a heavy grade of electrical insulation (as previously mentioned) for adequate voltage standoff capability to meet the switch's design peak terminal voltage. Activation of the electrical heater portion raises the temperature in the superconductive coil portion above the critical temperature.

Quench protection techniques for superconductive devices include techniques for preventing (or delaying) an impending quench and techniques for preventing (or limiting) harm to the superconductive device that is undergoing a quench. Such harm is from damaging high temperatures and high stresses applied locally to the magnet at the quench site. Known techniques for preventing (or limiting) such harm seek to avoid excessive localized heat energy deposition in the superconducting winding and include using a quench-detection signal (from the electrical center of the main superconductive coil assemblage of the superconductive device) directly supplying an energy dump resistor or directly powering a wide-area electrical heater located near the main superconductive coil assemblage of the superconductive device. Such known techniques take a relatively long time to work.

SUMMARY OF THE INVENTION

It is an object of the invention to provide a method for making an electrical coil, such as, but not limited to, the superconductive coil portion of a superconductive switch or the resistive coil portion of an energy dump resistor.

The method of the invention is a method for making an electrical coil and includes the steps of obtaining a generally cylindrical shaft having a middle, attaching a radially-extending pin to the shaft generally at the middle, obtaining a length of electrically-insulated coil wire having a midportion generally equidistant from two reference points, winding a first portion of the coil wire around a first rotatable supply spool, winding a second portion of the coil wire around a second rotatable supply spool, and looping the midportion of the coil wire around the pin. The method also includes the step of rotating the shaft in one direction and guiding the coil wire such that a first segment of the coil wire is paid out from the first supply spool and wound around the shaft generally from the middle to the first end and such that a first section of the coil wire is paid out from the second supply spool and wound around the shaft generally from the middle to the second end. The method additionally includes the step of continuing to rotate the shaft in the one direction and guiding the wire such that a second segment of the coil wire is paid out from the first supply spool and wound around the first segment of the wound coil wire generally from the first end to the middle and such that a second section of the coil wire is paid out from the second supply spool and wound around the first section of the wound coil wire generally from the second end to the middle. The method next includes the step of crossing over the coil wire from the first supply spool and the coil wire from the second supply spool generally at the middle and then includes the step of continuing to rotate the shaft in the one direction and guiding the coil wire such that a third segment of the coil wire is paid out from the first supply spool and wound around the second section of the wound coil wire generally from the middle to the second end and such that a third section of the coil wire is paid out from the second supply spool and wound around the second segment of the wound coil wire generally from the middle to the first end.

Preferably, the method of the invention includes, between the first and second segment/section winding steps, the step of placing a first electrical heater on the first segment and the first section of the wound coil wire and further includes, between the second and third segment/section winding steps, the step of placing a first stratum of electrical insulation, separate from that of the coil wire, on the second segment and the second section of the wound coil wire.

Several benefits and advantages are derived from the method of the invention. An electrical coil of, for example, a superconductive switch or an energy dump resistor can be wound without the need for heavy electrical insulation of the coil wire. The lighter electrical insulation used for the electrically-insulated coil wire of a superconductive switch does not compromise, for example, switch thermal conduction and quench propagation when the switch is used, for example, to quickly de-energize the main superconductive coil assemblage of a superconducting device by quickly energizing an energy dump resistor to protect the superconductive device from harm during a quench.

BRIEF DESCRIPTION OF THE DRAWINGS

The accompanying drawings illustrate a preferred embodiment of the present invention wherein.

DETAILED DESCRIPTION OF THE INVENTION

Figure 2:
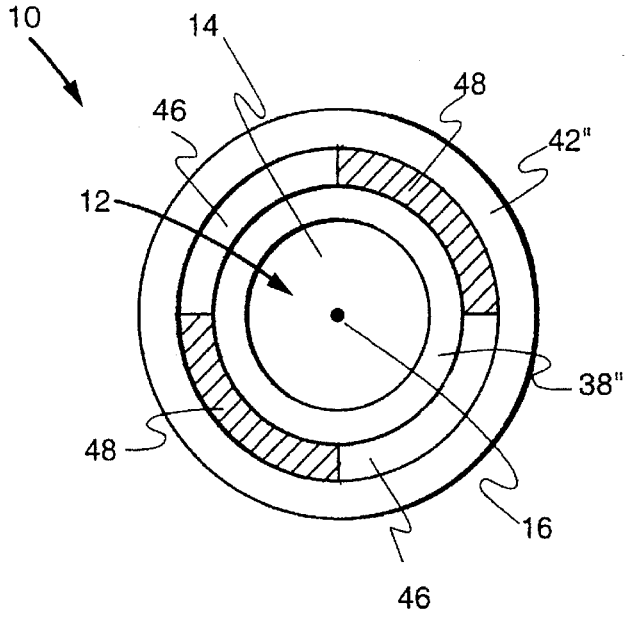
FIG. 2 is a sectional view of a portion of the superconductive switch of FIG. 1 taken along lines 2—2 of FIG. 1.
Figure 1:
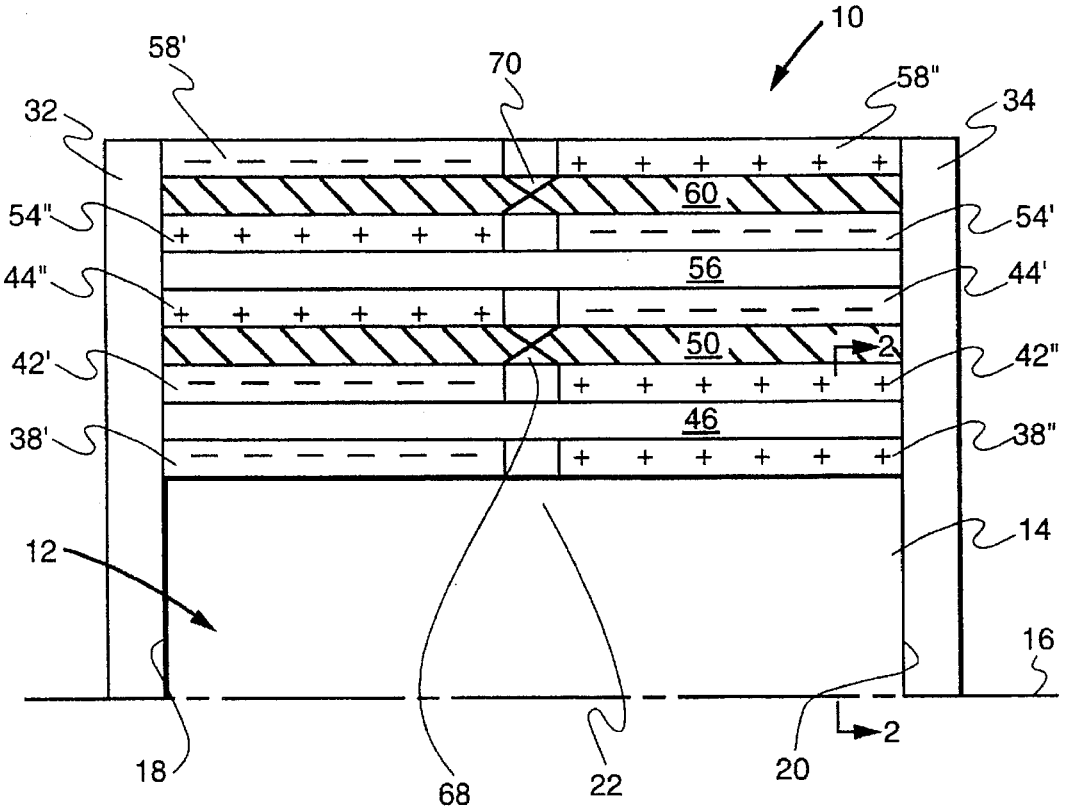
FIG. 1 is a schematic cross-sectional view of the top-half of a fully-wound superconductive switch, made by a preferred method of the present invention, which has been cut by a plane containing the longitudinal axis of the switch.
Figure 3:
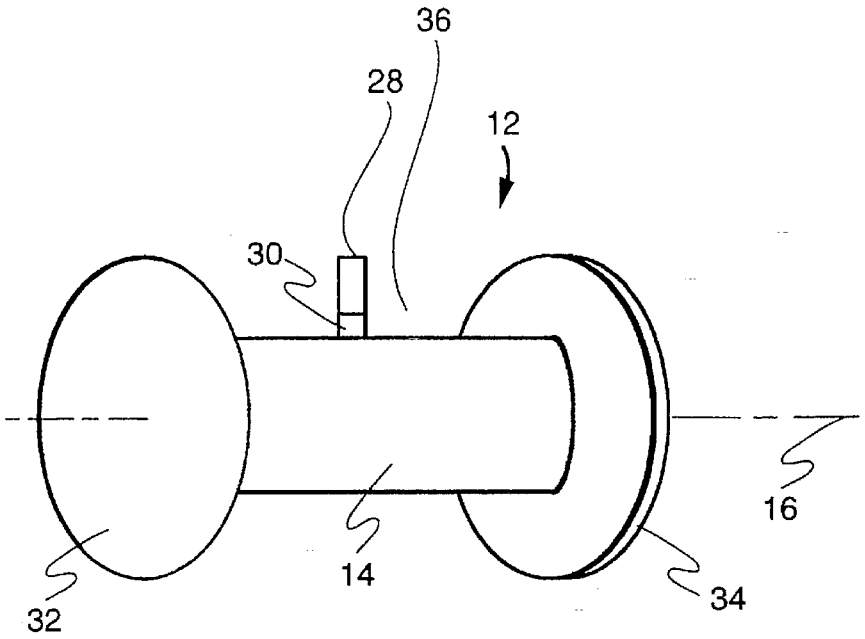
FIG. 3 is a schematic view of the coil form of the superconductive switch of FIG. 1.
Figure 4:
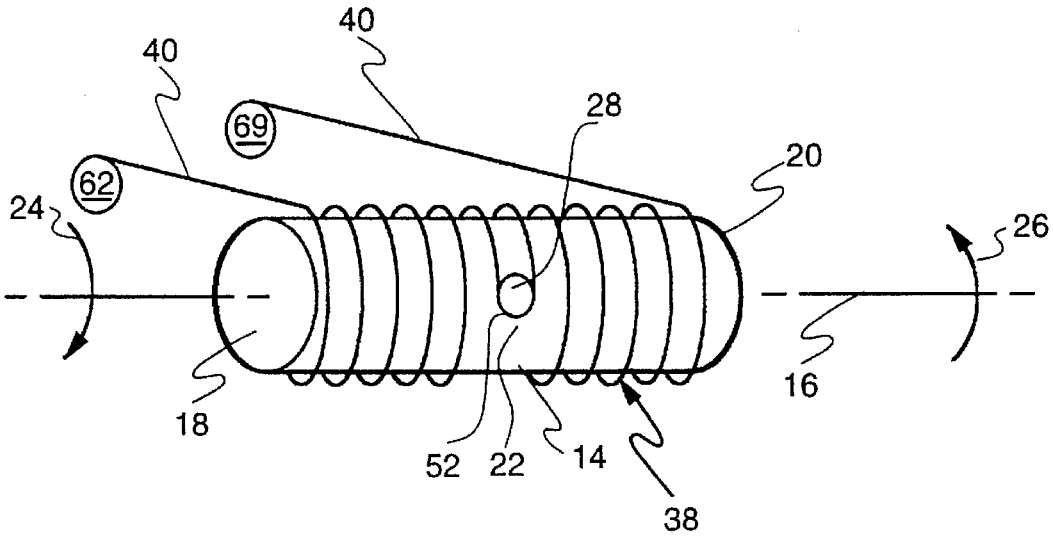
FIG. 4 is a schematic view of the coil form of FIG. 3 (with the two circular flanges removed from the coil form for clarity) together with two supply spools containing the coil wire used in the switch and with a first layer of coil wire shown wound around the shaft of the coil form.

Referring now to the drawings, FIGS. 1 and 2 show an electrical coil in the form of a superconductive switch 10 made by a preferred method of the present invention. In the following discussion, it is to be understood that all references to a superconductive switch 10 can be generalized to an electrical coil. The superconductive switch 10 includes a coil form 12 which is also shown in FIG. 3. The coil form 12 includes a generally cylindrical shaft 14 which is also shown in FIG. 4. The shaft 14 has a generally longitudinally extending axis 16, first and second ends 18 and 20, a middle 22 disposed generally equidistant from the ends 18 and 20, and clockwise and counterclockwise directions 24 and 26 about the axis 16 around the shaft 14. Preferably, the coil form 12 also includes a radially extending pin 28 attached to the shaft 14 generally at the middle 22, and the pin 28 includes a groove 30. In an exemplary embodiment, the coil form 12 also includes two generally circular flanges 32 and 34 each attached to a corresponding one of the ends 18 and 20 to define a spool having a generally annularly cylindrical space 36 longitudinally between the flanges 32 and 34 and radially outward of the shaft 14. In a preferred choice of materials, the coil form 12 comprises fiberglass. The entire coil form 12 may be of monolithic construction, or the circular flanges 32 and 34 and/or the pin 28 may be discrete parts attached to the shaft 14. The pin 28 is made of electrically insulating material, and more than one pin 28 (including circumferentially spaced apart and/or longitudinally adjacent pins attached to the shaft 14 generally at the middle 22) and/or more than one groove 30 may be used in particular applications.

The superconductive switch 10 also includes a first layer 38 of an electrically-insulated, stabilized superconductive coil wire 40 circumferentially wound around the shaft 14 in the clockwise direction 24 from the first end 18 to the middle 22 and in the counterclockwise direction 26 from the middle to the second end 20. FIG. 4 shows the individual turns of the coil wire 40 in the first layer 38, such individual turns being omitted from the first layer 38 in FIG. 1 for clarity and replaced by "–" signs in the first layer 38 of FIG. 1 representing turns wound in the clockwise direction 24 and by "+" signs in the first layer 38 of FIG. 1 representing turns wound in the counterclockwise direction 26. It is noted that electrically-insulated, stabilized superconductive coil wire is commercially available, and that, for the purpose of describing the present invention, a superconductive tape is considered to be a superconductive wire.

The superconductive switch 10 additionally includes a second layer 42 of the coil wire 40 circumferentially wound around the first layer 38 in the clockwise direction 24 (indicated by the "–" signs in the second layer 42 in FIG. 1) from the first end 18 to the middle 22 and in the counterclockwise direction 26 (indicated by the "+" signs in the second layer 42 in FIG. 1) from the middle 22 to the second end 20. The superconductive switch 10 further includes a third layer 44 of the coil wire 40 circumferentially wound around the second layer 42 in the counterclockwise direction 26 (indicated by the "+" signs in the third layer 44 in FIG. 1) from the first end 18 to the middle 22 and in the clockwise direction 24 (indicated by the "–" signs in the third layer 44 in FIG. 1) from the middle 22 to the second end 20. It is noted that the first, second, and third layers 38, 42, and 44 are layers wound from the same physical coil wire 40, and that the coil wire 40 may be a monolithic piece of coil wire or may be two or more discrete pieces of spliced-together coil wire.

The superconductive switch 10 moreover includes a first electrically-insulated, electrical heater 46 disposed between the first and second layers 38 and 42. Although the first layer 38 is shown directly contacting the shaft 14 in FIG. 1, the invention is not so limited, and there can be other wound layers of the coil wire between the first layer 38 and the shaft 12. In other words, the radially-inward layer closest to the first electrical heater 46 need not be the layer closest to the shaft 14. Electrically-insulated, electrical heaters are commercially available and are used in conventional superconductive switches. Preferably, the first electrical heater 46 is of the polyimide-insulated, etched-foil type and extends longitudinally between and generally to the ends 18 and 20. In an exemplary embodiment, the first electrical heater 46 extends circumferentially at least generally thirty degrees but less than a complete circle. In this construction, it is preferred that the superconductive switch 10 include at least one electrically-insulated, thermally-conductive metal strip 48 disposed between the first and second layers 38 and 42 (as seen in FIG. 4) and extending longitudinally between and generally to the ends 18 and 20 for quick and even heat transfer to the first and second layers 38 and 42. Preferably, the metal strip 48 is made of oxygen-free hard copper.

The superconductive switch 10 as well includes a first stratum of electrical insulation 50 discrete from that of the coil wire 40 and disposed between the second and third layers 42 and 44. Preferably, the superconductive switch 10 has a design peak terminal voltage, and the first stratum of electrical insulation 50 has a voltage standoff capability at least equal to the design peak terminal voltage. Although the first stratum of electrical insulation 50 is shown as the radially closest such stratum to the shaft 14 in FIG. 1, the invention is not so limited, and the first stratum of electrical insulation can be the radially furthest such stratum, or the first stratum of electrical insulation can be between the radially closest and furthest such strata. In an exemplary embodiment, the first stratum of electrical insulation 50 provides electrical insulation between the second and third layers 42 and 44 which is at least ten times better than the electrical insulation provided by the coil wire 40 itself. Preferably, the first stratum of electrical insulation 50 comprises fiberglass cloth and/or polyimide film. It is noted that fiberglass cloth will develop full voltage standoff capability only after post-winding resin impregnation, as is understood by those skilled in the art.

In a preferred construction, the first layer 38 includes a midportion 52 disposed generally equidistant from the ends 18 and 20 and looped around the pin 28. It is noted that the coil wire 40 makes a 180-degree hairpin bend around the pin 28. In an exemplary embodiment, the midportion 52 is disposed in the groove 30. Preferably, the first, second, and third layers 38, 42, and 44, the first electrical heater 46, and the first stratum of electrical insulation 50 are disposed in the space 36, such previously-defined space 36 being longitudinally between the flanges 32 and 34 and radially outward of the shaft 14, and such space 36 being shown empty in FIG. 3.

A particular application may call for a superconductive switch with additional buildup. Here, the superconductive switch 10 includes a fourth layer 54 of the coil wire 40 circumferentially wound around the third layer 44 in the counterclockwise direction 26 (indicated by the "+" signs in the fourth layer in FIG. 1) from the first end 18 to the middle 22 and in the clockwise direction 24 (indicated by the "–" signs in the fourth layer 54 in FIG. 1) from the middle 22 to the second end 20. A second electrically-insulated, electrical heater 56 is disposed between the third and fourth layers 44 and 54. The superconductive switch 10 includes a fifth layer 58 of the coil wire 40 circumferentially wound around the fourth layer 54 in the clockwise direction 24 (indicated by the "–" signs in the fifth layer 58 in FIG. 1) from the first end 18 to the middle 22 and in the counterclockwise direction 26 (indicated by the "+" signs in the fifth layer in FIG. 1) from the middle 22 to the second end 20. A second stratum of electrical insulation 60, discrete from that of the coil wire 40, is disposed between the fourth and fifth layers 54 and 58.

Referring to FIGS. 1 and 4, a preferred method of the present invention for making an electrical coil will be described in terms of the electrical coil being the previously-described superconductive switch 10. Such method includes the steps of: obtaining a generally cylindrical shaft 14 with a generally longitudinally extending axis 16, first and second ends 18 and 20, and a middle 22 disposed equidistant from the ends 18 and 20; attaching a radially-extending pin 28 to the shaft 14 generally at the middle 22; obtaining a length of electrically-insulated coil wire 40 having first and second reference points and having a midportion 52 disposed along the length generally equidistant from the reference points; winding a first portion of the coil wire 40 around a first rotatable supply spool 62 starting from the first reference point and ending proximate the midportion 52; winding a second portion of the coil wire 40 around a second rotatable supply spool 64 starting from the second reference point and ending proximate the midportion 52; and looping the midportion 52 around the pin 28.

The method also includes the step of rotating the shaft 14 in one direction (such as the clockwise direction 24) and guiding the coil wire 40 such that a first segment 38' of the coil wire 40 is paid out from the first supply spool 62 and wound around the shaft 14 generally from the middle 22 to the first end 18 and such that a first section 38" of the coil wire 40 is paid out from the second supply spool 64 and wound around the shaft 14 generally from the middle 22 to the second end 20. Next, the method includes the step of continuing to rotate the shaft 14 in the one direction (e.g., the clockwise direction 24) and guiding the coil wire 40 such that a second segment 42' of the coil wire 40 is paid out from the first supply spool 62 and wound around the first segment 38' of the wound coil wire 40 generally from the first end 18 to the middle 22 and such that a second section 42" of the coil wire 40 is paid out from the second supply spool 64 and wound around the first section 38" of the wound coil wire 40 generally from the second end 20 to the middle 22. Thereafter, the method includes the step of crossing over the coil wire 40 from the first supply spool 62 and the coil wire 40 from the second supply spool 64 generally at the middle 22. Then, the method includes the step of continuing to rotate the shaft 14 in the one direction (e.g., the clockwise direction 24) and guiding the coil wire 40 such that a third segment 44' of the coil wire 40 is paid out from the first supply spool 62 and wound around the second section 42" of the wound coil wire 40 generally from the middle 22 to the second end 20 and such that a third section 44" of the coil wire 40 is paid out from the second supply spool 64 and wound around the second segment 42' of the wound coil wire 40 generally from the middle 22 to the first end 18.

Figure 5:
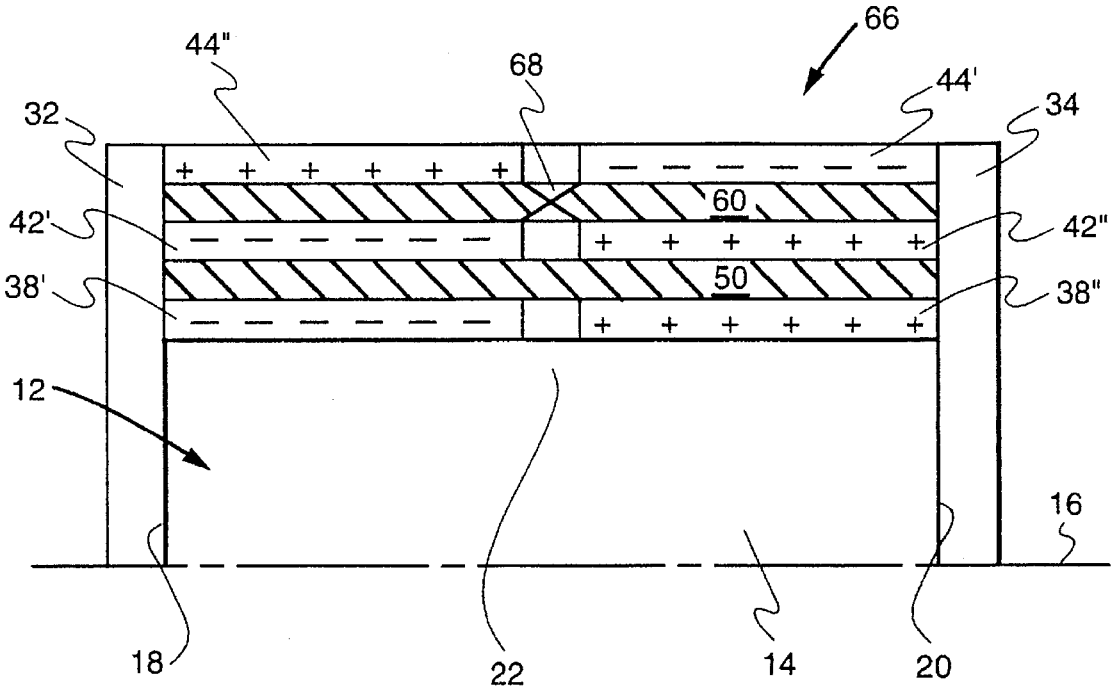
FIG. 5 is a schematic cross-sectional view of the top-half of a fully-wound energy dump resistor, made by a preferred method of the present invention, which has been cut by a plane containing the longitudinal axis of the resistor.

Preferably, the method of the present invention includes, between the second and third segment/section winding steps, the steps of obtaining a first stratum of electrical insulation 50 discrete from that of the coil wire 40 and disposing the first stratum of electrical insulation 50 on the second segment 42' and the second section 42" of the wound coil wire 40 such that the first stratum of electrical insulation 50 is disposed between the second segment 42' and the third section 44" of the wound coil wire 40 and between the second section 42" and the third segment 44' of the wound coil wire 40. In a first exemplary embodiment, the coil wire 40 is a resistive wire of an energy dump resistor 66 shown in FIG. 5.

Desirably, the method of the present invention includes, between the first and second segment/section winding steps, the step of disposing a first electrically-insulated, electrical heater 46 on the first segment 38' and the first section 38" of the wound coil wire 40 such that the first electrical heater 46 is disposed between the first segment 38' and the second segment 42' of the wound coil wire 40 and between the first section 38" and the second section 42" of the wound coil wire 40. In a second exemplary embodiment, the coil wire 40 is a superconductive wire of a superconductive switch 10 shown in FIG. 1. Preferably, the method includes, between the second and third segment/section winding steps, the steps of obtaining additional electrical insulation 68 discrete from that of the coil wire 40 and the first stratum of electrical insulation 50 and disposing the additional electrical insulation 68 around the coil wire 40 generally at the (first) crossover.

If continued buildup of the electrical coil is required, such as continued buildup of the superconductive switch 10, the method continues with the step of continuing to rotate the shaft 14 in the one direction (e.g., the clockwise direction 24) and guiding the coil wire 40 such that a fourth segment 54' of the coil wire 40 is paid out from the first supply spool 62 and wound around the third segment 44' of the wound coil wire 40 generally from the second end 20 to the middle and such that a fourth section 54" of the coil wire 40 is paid out from the second supply spool 64 and wound around the third section 44" of the wound coil wire 40 generally from the first end 18 to the middle 22. Next, the method includes the step of crossing over the coil wire 40 from the first supply spool 62 and the coil wire 40 from the second supply spool 64 generally at the middle 22. Then, the method includes the step of continuing to rotate the shaft 14 in the one direction (e.g., the clockwise direction 24) and guiding the coil wire 40 such that a fifth segment 58' of the coil wire 40 is paid out from the first supply spool 62 and wound around the fourth section 54" of the wound coil wire 40 generally from the middle 22 to the first end 18 and such that a fifth section 58" of the coil wire 40 is paid out from the second supply spool 64 and wound around the fourth segment 54' of the wound coil wire 40 generally from the middle 22 to the second end 20.

It is preferred that the method of the present invention include, between the third and fourth segment/section winding steps, the step of disposing a second electrically-insulated, electrical heater 56 on the third segment 44' and the third section 44" of the wound coil wire 40 such that the second electrical heater 56 is disposed between the third segment 44' and the fourth segment 54' of the wound coil wire 40 and between the third section 44" and the fourth section 54" of the wound coil wire 40. Also, the method desirably includes, between the fourth and fifth segment/section winding steps, the steps of obtaining a second stratum of electrical insulation 60 discrete from that of the coil wire 40 and disposing the second stratum of electrical insulation 60 on the fourth segment 54' and the fourth section 54" of the wound coil wire 40 such that the second stratum of electrical insulation 60 is disposed between the fourth segment 54' and the fifth section 58" of the wound coil wire 40 and between the fourth section 54" and the fifth segment 58' of the wound coil wire 40. Preferably, the method also includes the step of adding more additional electrical insulation 70 around the coil wire 40 at the last crossover in the same manner as additional electrical insulation 68 was added at the first crossover. Preferably, the additional electrical insulation 68 and 70 comprises polyimide tape.

It is noted that the area between the second and third layers 42 and 44 and the area between the fourth and fifth layers 54 and 58 are areas of high operating voltage stress. The first and second strata of electrical insulation 50 and 60 are placed in such high operating voltage stress areas. Low voltage stress is experienced between adjacent winding turns of the coil wire 40 except at the crossovers where the previously-discussed additional electrical insulation 68 and 70 is utilized. The area between the first and second layers 38 and 42 and the area between the third and fourth layers 44 and 54 are areas of low operating voltage stress. The first and second electrical heaters 46 and 56 are placed in such low operating voltage stress areas so as to concurrently quench the superconducting switch 10 longitudinally and radially across the whole space 36 so that the slow quench propagation across the first and second strata of electrical insulation 50 and 60 is bypassed, and the superconductive switch 10 becomes resistive very quickly. Circumferential switch quench propagation will be quick since it is governed by the properties of the superconductor stabilizer in the coil wire 40.

The first and second electrical heaters 46 and 56 may be connected electrically in series and/or in parallel to produce an appropriate resistance to match the switch triggering source, and the heater leads (not shown in the figures) are brought out of the switch winding. The crossover region around the pins 28 can be packed with fiberglass to fill voids. At the end of the last layer (i.e., the fifth layer 58 in FIG. 1) of wound coil wire 40, the coil-wire leads (not shown in the figures) are brought out of the winding. An overwrap of fiberglass cloth, metallic wire or strip, and/or nonmetallic yarn can be wound over the last layer (i.e., the fifth layer 58 in FIG. 1) of wound coil wire 40, and then the whole superconductive switch 10 impregnated with an epoxy or other polymer resin, wax, or other appropriate impregnant and thereafter cured.

The electrical coil in the form of the superconductive switch 10 made by the method of the present invention operates in the same manner as a conventional superconductive switch, but uses less electrical insulation in the coil wire. The invention provides a low-inductance superconductive switch where the voltage stress is no longer taken up by heavy turn-to turn electrical insulation (i.e., the heavy electrical insulation of the coil wire of a conventional superconductive switch), but by interlayer electrical insulation (i.e., the first and second strata of electrical insulation 50 and 60). As with a conventional superconductive switch, the superconductive switch 10 made by the method of the present invention preferably is used by placing it in a cryogenic region where the temperature is at or below the critical temperature of the superconducting material used in the coil wire 40 of the superconductive switch 10. The coil wire 40 will be superconducting until the first and second electrical heaters 46 and 56 are activated and raise the temperature in the coil wire 40 of the superconductive switch 10 above the critical temperature at which time the coil wire 40 will be resistive. De-activating the electrical heaters 46 and 56 will lead to a return of superconductivity in the coil wire 40 of the superconductive switch 10. The superconductive switch 10 of the invention is ideal for use in a superconductive magnet quench protection system (not shown in the figures) using kilovolt-class voltages to de-energize the superconductive magnet as quickly as possible and with its low-inductance being used so that current transfers quickly out of the switch into another electrical coil in the form of a parallel dump resistor (shown in FIG. 5) also made by the method of the present invention.

The foregoing description of several preferred methods of the invention has been presented for purposes of illustration. It is not intended to be exhaustive or to limit the invention to the precise form disclosed, and obviously many modifications and variations are possible in light of the above teaching. It is intended that the scope of the invention be defined by the claims appended hereto.

We claim:

1. A method for making an electrical coil comprising the steps of:

a) obtaining a cylindrical shaft with a longitudinally extending axis, first and second ends, and a middle disposed equidistant from said ends;

b) attaching a radially-extending pin to said shaft at said middle;

c) obtaining a length of electrically-insulated coil wire having first and second reference points and having a midportion disposed along said length equidistant from said reference points;

d) winding a first portion of said coil wire around a first rotatable supply spool starting from said first reference point and ending proximate said midportion;

e) winding a second portion of said coil wire around a second rotatable supply spool starting from said second reference point and ending proximate said midportion;

f) looping said midportion around said pin;

g) rotating said shaft in one direction about said longitudinally extending axis and guiding said coil wire such that:

(1) a first segment of said coil wire is paid out from said first supply spool and wound around said shaft generally from said middle to said first end; and (2) a first section of said coil wire is paid out from said second supply spool and wound around said shaft generally from said middle to said second end;

h) after step g), continuing to rotate said shaft in said one direction and guiding said coil wire such that:

(1) a second segment of said coil wire is paid out from said first supply spool and wound around said first segment of said wound coil wire generally from said first end to said middle; and (2) a second section of said coil wire is paid out from said second supply spool and wound around said first section of said wound coil wire generally from said second end to said middle:

i) after step h), crossing over said coil wire from said first supply spool and said coil wire from said second supply spool generally at said middle; and j) after step i), continuing to rotate said shaft in said one direction and guiding said coil wire such that:

(1) a third segment of said coil wire is paid out from said first supply spool and wound around said second section of said wound coil wire generally from said middle to said second end; and (2) a third section of said coil wire is paid out from said second supply spool and wound around said second segment of said wound coil wire generally from said middle to said first end.

2. The method of claim 1, also including, between steps h) and j), the steps of obtaining a first stratum of electrical insulation discrete from that of said coil wire and disposing said first stratum of electrical insulation on said second segment and said second section of said wound coil wire such that said first stratum of electrical insulation is disposed between said second segment and said third section of said wound coil wire and between said second section and said third segment of said wound coil wire.

3. The method of claim 2, wherein said coil wire is a resistive coil wire of an energy-dump resistor.

4. The method of claim 2, also including, between steps g) and h), the step of disposing a first electrically-insulated, electrical heater on said first segment and said first section of said wound coil wire such that said first electrical heater is disposed between said first segment and said second segment of said wound coil wire and between said first section and said second section of said wound coil wire.

5. The method of claim 4, wherein said coil wire is a superconductive coil wire of a superconductive switch.

6. The method of claim 5, also including, between steps h) and j), the steps of obtaining additional electrical insulation discrete from that of said coil wire and said first stratum of electrical insulation and disposing said additional electrical insulation around said coil wire generally at said crossover.

7. The method of claim 5, also including, after step j), the step of:

k) continuing to rotate said shaft in said one direction and guiding said coil wire such that:

(1) a fourth segment of said coil wire is paid out from said first supply spool and wound around said third segment of said wound coil wire generally from said second end to said middle; and (2) a fourth section of said coil wire is paid out from said second supply spool and wound around said third section of said wound coil wire generally from said first end to said middle.

8. The method of claim 7, also including, between steps j) and k) the step of disposing a second electrically-insulated, electrical heater on said third segment and said third section of said wound coil wire such that said second electrical heater is disposed between said third segment and said fourth segment of said wound coil wire and between said third section and said fourth section of said wound coil wire.

9. The method of claim 8, also including the steps of:

l) after step k), crossing over said coil wire from said first supply spool and said coil wire from said second supply spool generally at said middle; and m) after step l), continuing to rotate said shaft in said one direction and guiding said coil wire such that:

(1) a fifth segment of said coil wire is paid out from said first supply spool and wound around said fourth section of said wound coil wire generally from said middle to said first end; and (2) a fifth section of said coil wire is paid out from said second supply spool and wound around said fourth segment of said wound coil wire generally from said middle to said second end.

10. The method of claim 9, also including, between steps k) and m), the steps of obtaining a second stratum of electrical insulation discrete from that of said coil wire and disposing said second stratum of electrical insulation on said fourth segment and said fourth section of said wound coil wire such that said second stratum of electrical insulation is disposed between said fourth segment and said fifth section of said wound coil wire and between said fourth section and said fifth segment of said wound coil wire.

* * * * *